US008092168B2

(12) United States Patent
Vedhagiri et al.

(10) Patent No.: US 8,092,168 B2
(45) Date of Patent: Jan. 10, 2012

(54) PATCH PLUG REPAIR OF A COMPRESSOR CASE STATOR RING HOOK, NEAR THE HORIZONTAL JOINT

(75) Inventors: Sivaraman Vedhagiri, Greer, SC (US); Jeffery C Moree, Greer, SC (US); Erik Scot Velthaus, Lyndhurst, NJ (US)

(73) Assignee: General Electric Company, Schenectady, NY (US)

( * ) Notice: Subject to any disclaimer, the term of this patent is extended or adjusted under 35 U.S.C. 154(b) by 454 days.

(21) Appl. No.: 12/421,675

(22) Filed: Apr. 10, 2009

(65) Prior Publication Data

US 2010/0260601 A1 Oct. 14, 2010

(51) Int. Cl.
*F01D 25/24* (2006.01)

(52) U.S. Cl. ..... 415/214.1; 29/888.021

(58) Field of Classification Search ..... 415/189, 415/190, 196, 197, 209.2–209.4, 214.1; 29/888.021, 29/889.1

See application file for complete search history.

(56) References Cited

U.S. PATENT DOCUMENTS

| | | | | |
|---|---|---|---|---|
| 6,439,842 | B1 | 8/2002 | Toomey | |
| 6,969,826 | B2 * | 11/2005 | Trewiler et al. | 219/137 R |
| 6,969,932 | B2 * | 11/2005 | Kim et al. | 310/59 |
| 6,984,108 | B2 | 1/2006 | Anderson | |
| 7,338,263 | B2 * | 3/2008 | Young | 418/55.1 |
| 2007/0116589 | A1 * | 5/2007 | Young | 418/55.1 |
| 2010/0064514 | A1 * | 3/2010 | Kersteman | 29/888.021 |
| 2011/0254268 | A1 * | 10/2011 | Johnson et al. | 285/407 |

* cited by examiner

*Primary Examiner* — Gary F. Paumen
(74) *Attorney, Agent, or Firm* — Pearne & Gordon LLP

(57) ABSTRACT

A compressor case, and an associated method, repaired from damage to a segment of a stator ring hook. Two halves are engaged together at flange faces that define parting lines and that define a hollow interior, the ring hook being located at the interior, compressor case material having been removed at the stator ring hook location and a location of one of the flange faces to provide a space. A patch plug is slid into the space from the one flange face, the shape of the patch plug being complementary to a shape of the missing material space and inter-fitting therein, with an end of the patch plug being located at the one flange face to face an opposed half of the case with the two halves together. A fastener fastens the patch plug to the case and extending from the interior, through the patch plug, to the case.

10 Claims, 3 Drawing Sheets

PATCH PLUG REPAIR OF A COMPRESSOR CASE STATOR RING HOOK, NEAR THE HORIZONTAL JOINT

BACKGROUND OF THE INVENTION

1. Field of the Invention

The present invention relates generally to gas turbine engine compressor cases, and more particularly to repair of damage to compressor cases.

2. Discussion of Prior Art

As turbine engines have a stator and one or more rotors rotatably mounted on the stator. The rotors have blades arranged in circumferential rows. Each of the blades extends outward from a root to a tip. The stator is provided as a tubular compressor case that houses the rotor, such that the rotor blades rotate within the case. Within the compressor case, it is typically intended that there be minimum clearance between blade tips and the interior surface of the case to improve engine efficiencies and the like.

It is to be appreciated that a compressor case may be damaged during transport, positioning or assembly. In particular, certain portions of a compressor case may be prone to damage due to location and/or relative size. One area that may be damaged during such transport, positioning or assembly, is a compressor case stator ring hook. Such damage may be particularly prone to occur near the flange faces that meet together at parting lines of two halves of a compressor case. Currently, it is possible to provide a repair in the form an encircling patch ring that is to be added into the compressor case in an inscribing manner to the entire compressor case.

BRIEF DESCRIPTION OF THE INVENTION

In accordance with one aspect, the present invention provides a compressor case that includes two halves engaged together at flange faces that define parting lines and that define a hollow interior. The ring hook is located at the interior of the compressor case. Compressor case material is missing at the stator ring hook location to create a missing material space from a location of one of the flange faces, along the stator ring hook and including a stator ring hook missing material segment. A patch plug is slid into the space from the one flange face. A shape of the patch plug is complementary to a shape of the missing material space and inter-fitting into the missing material space, with an end of the patch plug being located at the one flange face to face an opposed half of the compressor case with the two halves together. A fastener fastens the patch plug to the compressor case and extends from the interior of the compressor case, through the patch plug, to the compressor case.

In accordance with another aspect, the present invention provides a method of repairing a damaged segment of a turbine compressor case stator ring hook. The compressor case has a hollow interior and is provided as two halves engaged together at flange faces that define parting lines. The ring hook is located at the interior of the compressor case. The method includes removing material of the compressor case at the stator ring hook location to create a missing material space. This material removal includes removing compressor case material from a location of one of the flange faces, along the stator ring hook and including the damaged segment of the stator ring hook. The method includes sliding a patch plug into the space from the one flange face. The shape of the patch plug is complementary to a shape of the missing material space and inter-fitting into the missing material space, with an end of the patch plug being located at the one flange face to face an opposed half of the compressor case when the two halves of the compressor case are brought together. The method including fastening the patch plug to the compressor case by a fastener that extends from the interior of the compressor case, through the patch plug, to the compressor case.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
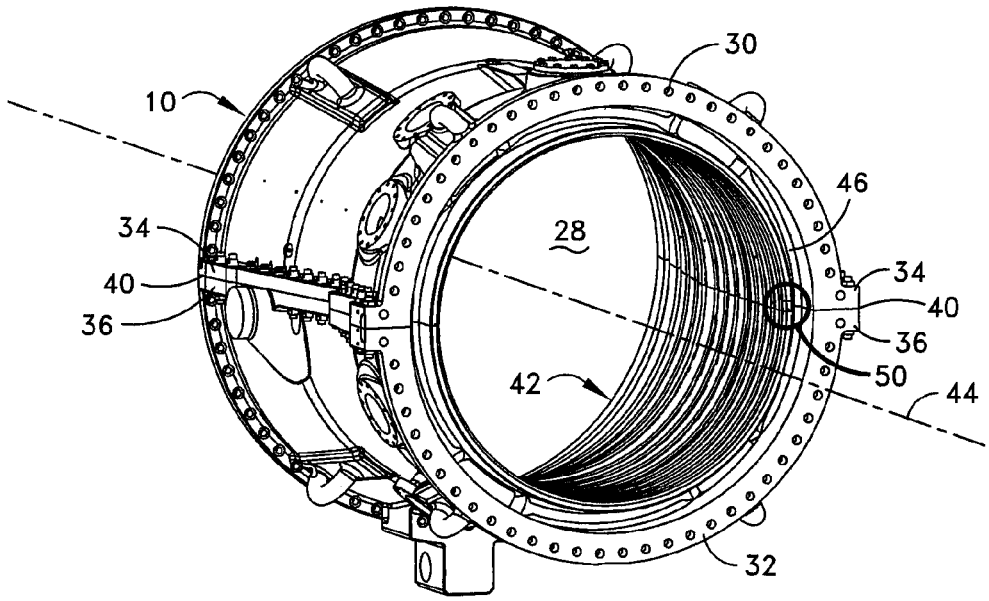
FIG. 1 is a perspective view of an example compressor case that include a patch plug repair in accordance with one aspect of the present invention.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Figure 2:
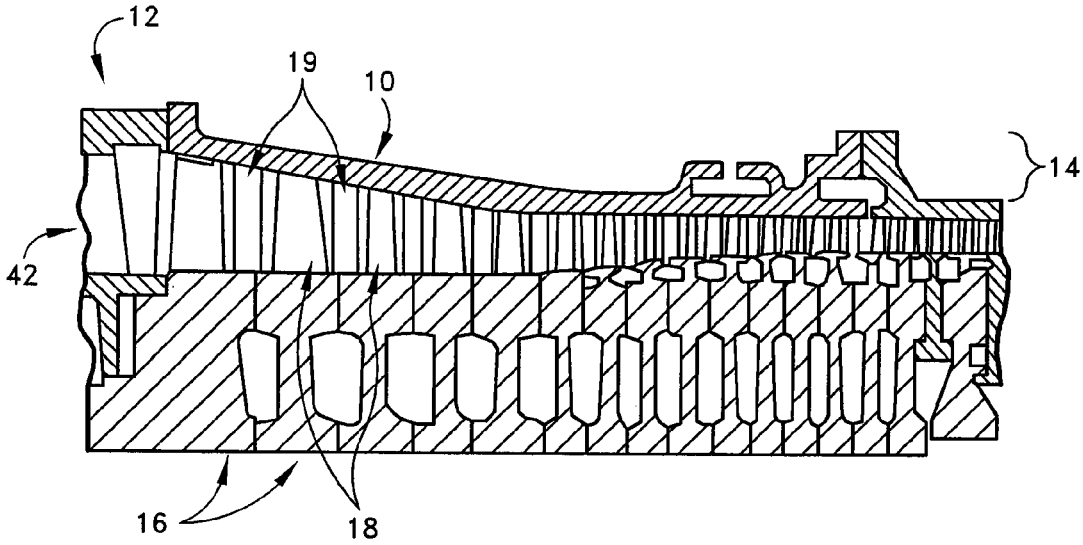
FIG. 2 is a section view of a part of an example turbine that may include a compressor case repaired in accordance with one aspect of the present invention.

An example of a hollow, tubular compressor case 10 is shown in FIG. 1. The compressor case 10 is part of a turbine engine 12, as shown in FIG. 2. The turbine engine 12 has the compressor case 10 as part of a stator 14, and the engine has one or more rotors 16 rotatably mounted within the stator. The rotors 16 have blades 18 arranged in circumferential rows. Each of the blades 18 extends radially outward from a root to a tip. The compressor case 10 houses the stator blades 19 on circumferential rows. Each of the stator blades extend radially inward from a root to a tip. The compressor case 10 houses the rotors 16, such that the rotor blades 18 rotate within the compressor case. As can be appreciated there is a large number of rotor blades 18. Typically there is minimum clearance between blade tips and the interior surface of the compressor case 10 to improve engine efficiencies and the like. The exact specifics concerning particular construction of the turbine engine 12, the number of blades, dimensions, and the like are not limitations on the present invention. However, it is noteworthy to acknowledge that a hollow interior 28 of the compressor case 10 is configured and constructed with great precision concerning dimensions.

Turing back to FIG. 1, it is noted that the compressor case 10 is constructed of two halves 30, 32 that are secured together to provide the tubular shape with the hollow interior 28. The two compressor case halves 30, 32 meet together at opposed facing flanges 34, 36 at parting lines 40. The flanges 34, 36 each include a plurality aligned openings to receive bolts or the like for securing the two halves together. Of course, other and/or additional securing means may be employed.

Within the compressor case 10 is a series of inner surface contours 42 that are spaced along the axis 44 of the compressor case and that mate in close proximity to the blades 19. One specific inner surface contour is a compressor case stator ring hook 46, which is located at an axial end of the compressor case 10 (i.e., at the opening to the hollow interior of the compressor case). Being located at the end, the compressor case stator ring hook 46 is somewhat exposed and susceptible to damage during transport, positioning and assembly. For example, the halves 30, 32 of the compressor case 10 are relatively heavy and it is possible that during transport, positioning or assembly, the compressor case half (e.g., 30) will inadvertently engage something (e.g., the other half 32 in a misaligned condition) and weight of the compressor case half will cause deformation/damage of the compressor case stator ring hook 46. Examples of such deformation/damage is bending or chipping. Other examples include mis-machining and casting defect exposed by machining. As can be appreciated that deformation/damage may be problematic in view of the great precision concerning dimensions and the interaction with the blades.

Figure 3:
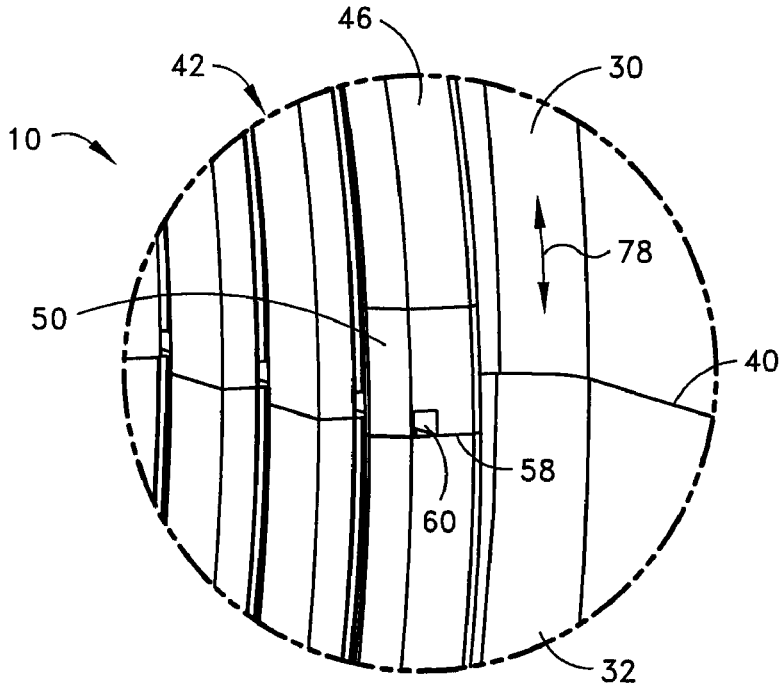
FIG. 3 is an enlarged view of a portion of the compressor case of FIG. 1 with a patch in accordance with one aspect of the present invention.

One aspect of the present invention is the provision of a patch plug 50 at the location of the damage to the compressor case stator ring hook 46. The encircled area in FIG. 1 highlights the patch plug 50 on the compressor case 10. Turning to FIG. 3, the placement of the patch plug 50 is better viewed. Specifically, the patch plug 50 is located at the compressor case stator ring hook 46. Also, in accordance with one aspect of the present invention, the patch plug 50 is located adjacent to a face 56 of the flange (e.g., 34) of the half (e.g., 30) of the compressor case 10. It is to be recalled that the two compressor case halves 30, 32 meet together at parting lines 40.

It should be noted that in the shown example provided via the drawings, the patch plug 50 is located on the first compressor case half 30. It is to be appreciated that the patch plug 50 may be located on the second compressor case half 32.

Figure 4:
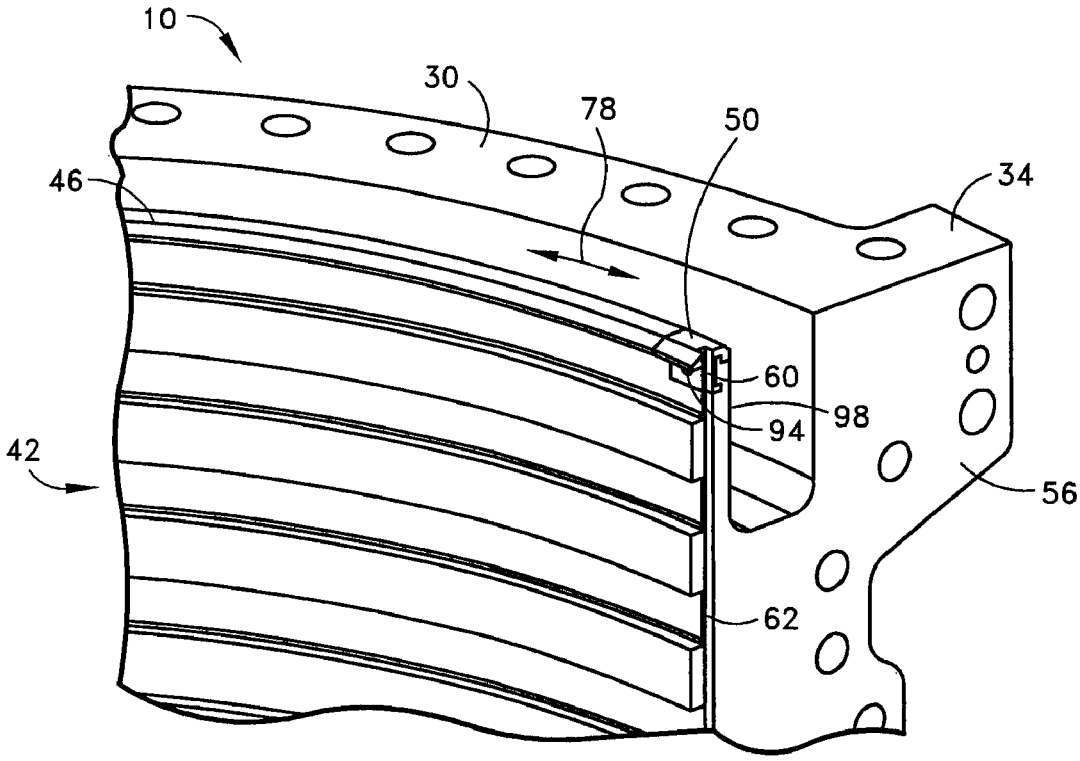
FIG. 4 is a perspective view of a portion of a half of the example compressor case and example patch plug shown in FIG. 1.

Turing to some details of the patch plug 50 attention is directed to FIG. 4. One aspect is that the patch plug 50 is relatively small or short when compared to the overall circumferential distance dimension of the compressor case stator ring hook 46. The specific length of the patch plug will be dependant upon the size of the damaged area on the compressor case stator ring hook 46. Of course, in the provided example shown in the drawings, the damaged area has already been removed and discussed further below. The material removal can be accomplished by simple compact machining, drilling, grinding, or the like. The removal of material creates a missing material space. Of course, a missing material space would be produced by other techniques.

The radially inward profile of the patch plug 50 is the same as the inward profile of the compressor case stator ring hook 46. So, in one respect, the patch plug becomes and provides part of the compressor case stator ring hook 46. As best appreciated by viewing FIGS. 3 and 4, an end face of the patch plug 50 is flat to lie in the same plane at the flange face 56. It is to be appreciated that the end face of the patch plug 50 will generally abut the opposed face of the opposed compressor case half 32. This abutting to the opposed face is best seen in FIG. 3. In the shown example, the patch plug 50 also includes a channel segment 60 that is aligned with a channel 62 in the compressor case half 30 at the flange face 56 (best seen in FIG. 4). The channel 62 in the flange face 56 is for receipt of a blade retention member, and the channel segment 60 in the patch plug 50 replicates/mimics this function.

Figure 5:
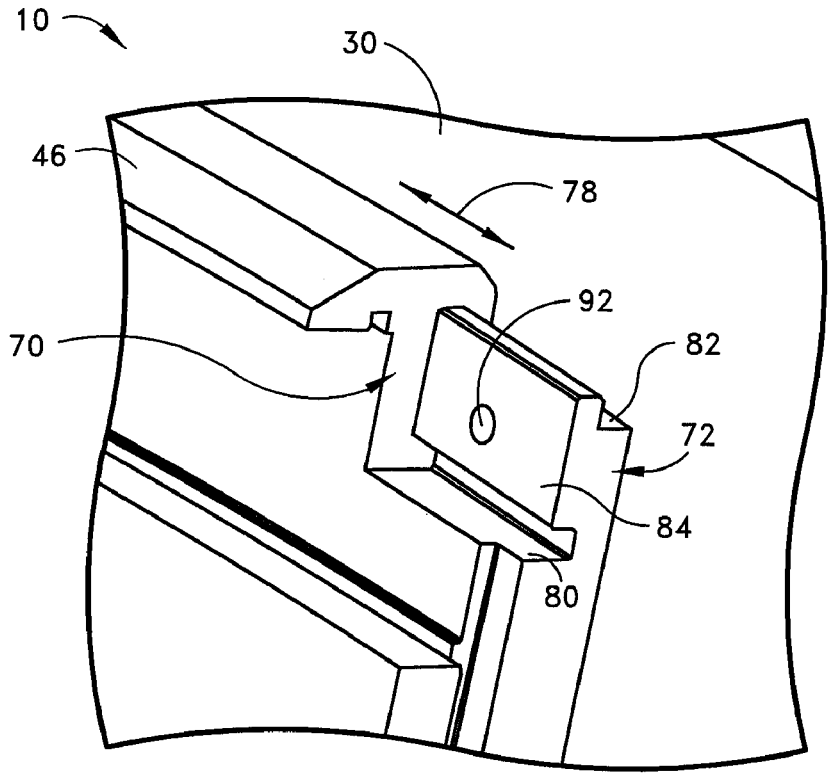
FIG. 5 is a further enlarged view of the compressor case half shown in FIG. 4, with the patch plug removed to show a space from which material was removed from the compressor case so as to receive the patch plug.
Figure 6:
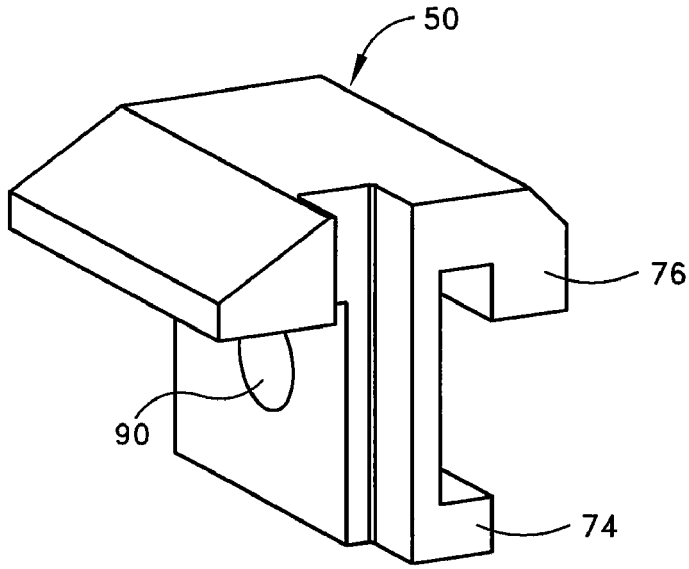
FIG. 6 is perspective view of the example patch plug.

It is to be appreciated that to place the patch plug 50 onto the compressor case half 30, a portion of the compressor case 10 at the compressor case stator ring hook 46 must be removed to provide a space 70 for receipt of the patch plug 50. FIG. 5 shows an example of the space 70 that is present after removal of the material from the compressor case 10. In the shown example, the removal of material is such that a remaining material portion 72 of the compressor case and the patch plug 50 mate together. Specifically, a comparison of the space 70 shown in FIG. 5 and the example patch plug 50 of FIG. 6 provides an understanding of the ability to mate together. Thus, the space 70 and the patch plug 50 inter-fit and are complementary. This mating provides a retention function.

In the shown example of FIG. 6, the patch plug 50 has rails 74, 76. Specifically, the rails 74, 76 extend along the patch plug 50 and extend along the annular direction 78 of the compressor case 10. The space 70 provided after removal of material from the compressor case 10 includes rail-receiving segments 80, 82 for the patch plug rails 74, 76. In the shown example, the removed material space 70 has two rail-receiving segments, identified as a first segment 80 and a second segment 82, respectively. This first rail receiving segment 80 is located adjacent to a material segment 84 of the remaining material portion 72 such that the first rail receiving segment 80 can be considered to be a groove. The second rail-receiving segment 82 of the removed material is adjacent to an axial end of the compressor case 10 and radially outward of the material segment 84 of the remaining material portion 72. The orientation of the segments is such that the patch plug 50 is placed onto the compressor case 10 via movement in the annular direction 78. Specifically, the patch plug 50 slides into the space 70 from the open flange side, with the patch plug rails 74, 76 sliding into the segments 80, 82.

With the patch plug 50 located on the compressor case 10 (see FIG. 4), the material segment 84 of remaining (i.e., non-removed) material portion 72 is between the first rail 74 of the patch plug and an axial end of the of the compressor case 10. Thus, the material segment 84 blocks and prevents direct movement of the patch plug 50 axially outward from the compressor case 10 (i.e., blocks movement in the direction out away from the end of the compressor case). Also, with the second rail 76 of the patch plug 50 being located radially outward of the material segment 84, the non-removed material blocks and prevents radially inward movement of the second rail. Also, the material segment 84, and the rest of the compressor case 10 itself located axially below the patch plug 50 prevent movement of the patch plug axially inward (i.e., further into the compressor case 10, away from the axial end).

It is to be appreciated that in the shown example, the remaining material portion 72 is actually a portion that remains after some material removal. The remaining material portion 72 and the first and second rail-receiving segments 80, 82 have shapes and configurations that may differ from the shown example. Also, a different number of rail-receiving segments may be provided. Overall, some function of retaining the patch plug may be provided regardless of modification of shapes and configurations.

In the shown example, a fastener receiving opening 90 (FIG. 6) is provided through the patch plug 50 and a fastener receiving opening (92) is provided in the compressor case 10 at the remaining material portion 72. A fastener 94 (See FIG. 4) extends through the opening 90 though the patch plug 50 and extends into the opening 92 in the compressor case 10 to fasten/retain the patch plug 50 onto the compressor case. The fastener 94 may provide a retention function in the radially inward direction and axial directions (axially outward and inward relative to the compressor case 10). However, due to the mating of the rails 74, 76 to the compressor case 10, the fastener 94 need not bear all possible force that may urge movement of the patch plug 50 relative to the compressor case. Some or even all such movement urging force may be born at the interaction between the rails 74, 76 and the compressor case 10. The bearing of force may be directional dependent. For example, the fastener 94 may bear some movement urging force only in the radially inward direction and the fastener may bear little or no movement urging force in the axial directions.

In one example, the fastener 94 is a threaded member, with a corresponding thread in the opening 92 in the compressor case 10. Also, in one example the opening 90 though the patch plug 50 may have compound diameters so that a head of the fastener 94 may be recessed to be flush within the patch plug (i.e., so as not to protrude radially inward). Also, in one example the opening 92 in the compressor case 10 does not extend through to a radially outward surface 98 (see FIG. 4) on the compressor case. Thus, the opening 92 is a blind hole. With the use of a blind hole as the opening 92, there can be no transfer of gases, pressure, etc. to or from the inside of the compressor case 10 at the patch plug location.

It should be noted that the fastener 94 may be modified from the described example. It is possible that the fastener 94 may even be or include adhesive. It is noted that regardless of the fastener utilized, one aspect of the present invention is that the fastener does not bear any full movement urging force due to the mating relationship of the rails. In one embodiment, the fastener is permanently attached and secured.

Of course, upon mating and securing of the two halves 30, 32 of the compressor case 10 together, the patch plug 50 is further blocked from movement. Specifically, the patch plug 50 is blocked and prevented from sliding back out along its route of introduction. So, the patch plug 50 cannot move (i.e., slide) in the annular direction 78 out from the missing material space 70.

So, it should be appreciated that one aspect of the present invention is a method of repairing a damaged segment of a turbine compressor case stator ring hook. The compressor case has a hollow interior and is provided as two halves engaged together at flange faces that define parting lines. The ring hook is located at the interior of the compressor case. The method includes removing material of the compressor case at the stator ring hook location to create a missing material space. This step includes removing compressor case material from a location of one of the flange faces, along the stator ring hook and including the damaged segment of the stator ring hook. The patch plug is slide into the space from the flange face. The shape of the patch plug is complementary to a shape of the removed material space and inter-fits into the removed material space. The end of the patch plug is located at the one flange face to face the opposed half of the compressor case when the two halves of the compressor case are brought together. The patch plug is fastened to the compressor by a fastener that extends from the interior of the compressor case, through the patch plug, to the compressor case.

Some example specifics for such a method include the patch plug having the rails, and the step of removing material of the compressor including removing material to create spaces for patch plug rails. The step of sliding the patch plug into the space thus includes sliding the patch plug rails into the spaces for the patch plug rails.

As another example specific for such a method is that the step of fastening the patch plug to the compressor includes extending the fastener so that the fastener does not penetrate to the outside of the compressor case. In one specific example the fastener is a screw and the step of fastening the patch plug to the compressor includes permanently securing the screw to prevent removal.

As yet another example with the one flange face having the elongate channel and the patch plug having the channel segment that is complementary to the elongate channel, the step of sliding the patch plug into the space includes aligning the channel segment with the elongate channel.

The material of plug can match the material of the compressor case. However, it is possible that the material of the plug may differ from the material of the compressor case. The plug is usually small relatively and hence can be precision-machined to required specification and shipped to repair location The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

The invention claimed is:

1. A compressor case including:

two halves engaged together at flange faces that define parting lines and that define a hollow interior, a ring hook being located at the interior of the compressor case, compressor case material missing at the stator ring hook location to create a missing material space from a location of one of the flange faces along the stator ring hook and including a stator ring hook missing material segment;

a patch plug slid into the space from the one flange face, a shape of the patch plug being complementary to a shape of the missing material space and inter-fitting into the missing material space, with an end of the patch plug being located at the one flange face to face an opposed half of the compressor case with the two halves together; and a fastener fastening the patch plug to the compressor case and extending from the interior of the compressor case, through the patch plug, to the compressor case.

2. A compressor case as set forth in claim 1, wherein the patch plug includes rails, the missing material space of the compressor case includes space segments, and the rails of the patch plug being located in the space segments.

3. A compressor case as set forth in claim 1, wherein the fastener does not penetrate through the compressor case.

4. A compressor case as set forth in claim 3, wherein the fastener is a screw permanently secured to prevent removal.

5. A compressor case as set forth in claim 1, wherein the one flange face includes an elongate channel, the patch plug includes a channel segment that is complementary to the elongate channel, and the channel segment is aligned with the elongate channel.

6. A method of repairing a damaged segment of a turbine compressor case stator ring hook, the compressor case having a hollow interior and being provided as two halves engaged together at flange faces that define parting lines, the ring hook being located at the interior of the compressor case, the method including:

removing material of the compressor case at the stator ring hook location to create a missing material space, including removing compressor case material from a location of one of the flange faces, along the stator ring hook and including the damaged segment of the stator ring hook;

sliding a patch plug into the space from the one flange face, a shape of the patch plug being complementary to a shape of the missing material space and inter-fitting into the missing material space, with an end of the patch plug being located at the one flange face to face an opposed half of the compressor case when the two halves of the compressor case are brought together; and fastening the patch plug to the compressor case by a fastener that extends from the interior of the compressor case, through the patch plug, to the compressor case.

7. A method as set forth in claim 6, wherein the patch plug has rails, the step of removing material of the compressor case includes removing material to create spaces for the patch plug rails, and the step of sliding the patch plug into the space includes sliding the patch plug rails into the spaces for the patch plug rails.

8. A method as set forth in claim 6, wherein the step of fastening the patch plug to the compressor case includes extending the fastener so that the fastener does not penetrate through the compressor case.

9. A method as set forth in claim 8, wherein the fastener is a screw and the step of fastening the patch plug to the compressor case includes permanently securing the screw to prevent removal.

10. A method as set forth in claim 6, wherein the one flange face has an elongate channel, the patch plug has a channel segment that is complementary to the elongate channel, the step of sliding the patch plug into the space includes aligning the channel segment with the elongate channel.

* * * * *